US005332395A

United States Patent [19]

Wen-Yu

[11] Patent Number: 5,332,395

[45] Date of Patent: Jul. 26, 1994

[54] COMPUTER CABLE CONNECTORS

[76] Inventor: Tang Wen-Yu, No. 16, Chung-Hwa St., Kuei-Shan Hsiang, Tao-Yuan Hsien, Taiwan

[21] Appl. No.: 18,263

[22] Filed: Feb. 16, 1993

[51] Int. Cl.[5] ..... H01R 4/24

[52] U.S. Cl. ..... 439/405; 439/610

[58] Field of Search ..... 439/395–405, 439/638, 654, 685, 686, 695, 696, 701, 607, 609, 610

[56] References Cited

U.S. PATENT DOCUMENTS

| | | | |
|---|---|---|---|
| 4,147,399 | 4/1979 | Moser et al. | 439/404 |
| 4,431,249 | 2/1984 | Frantz et al. | 439/404 |
| 4,470,655 | 9/1984 | Kalka et al. | 439/404 |
| 4,703,990 | 11/1987 | Assmann et al. | 439/404 |
| 4,744,772 | 5/1988 | Reichardt et al. | 439/405 |
| 4,891,020 | 2/1990 | Dunn | 439/405 |

*Primary Examiner*—David L. Pirlot

[57] ABSTRACT

A computer cable connector, comprising a plurality of contacts respectively fastened in a plurality of holes on an insulator assembly covered by a metal shell and respectively connected to the wires of a flat cable, wherein said contacts are consisted of a bar of connecting terminals connected to a car of contact terminals, each contact terminal comprising a straight body having a unitary rectangular frame at a tail thereof, each connecting terminal being made in a flat structure including a body, a unitary, flat projecting strip extending from said body at one end and a flat, forked tail extending from said body at an opposite end, said flat projecting strip being inserted into said rectangular frame and secured in place through a rivet joint respectively, said bar of connecting terminals including one at the middle having the projecting strip and the body thereof longitudingally aligned, and the others having the projecting strips thereof respectively deviated from respective central axes through different angles so that a constant pitch is maintained between either two adjacent projecting strips.

1 Claim, 12 Drawing Sheets

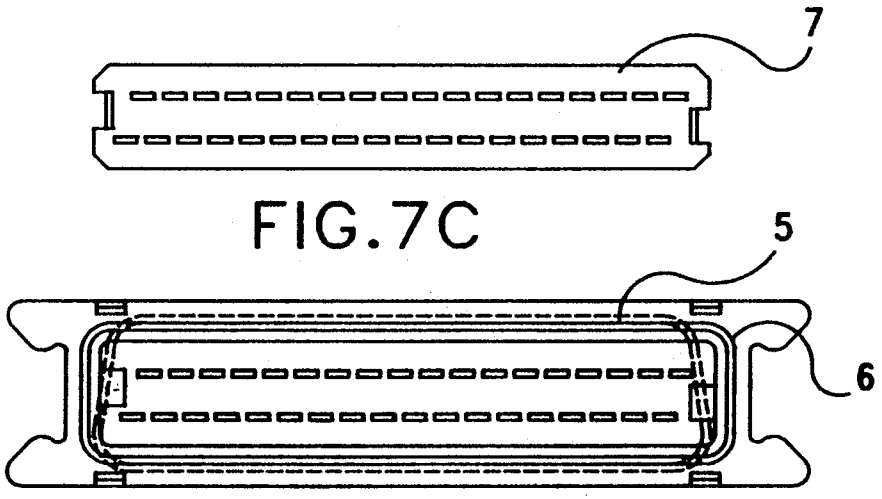
FIG. 7C
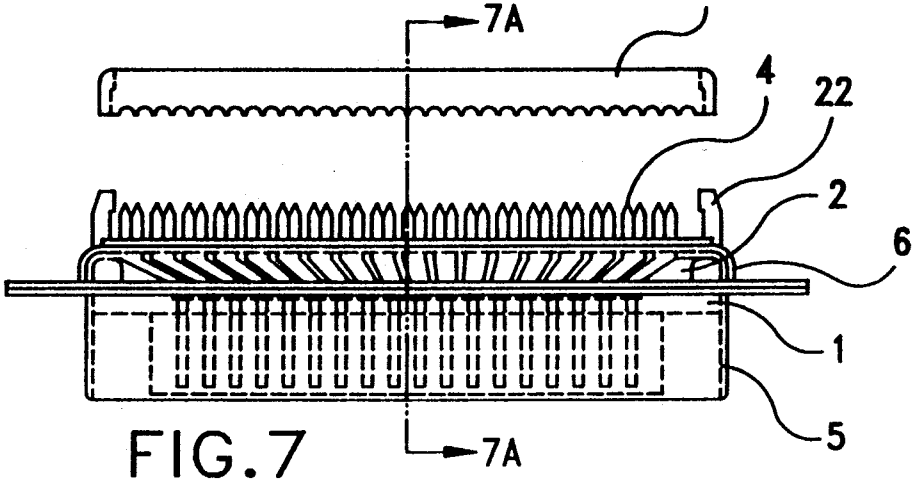
FIG. 7B
FIG. 7
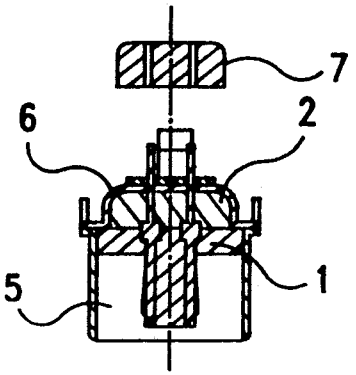
FIG. 7A 7
6
2
R4
4
R3
3
1
5
10A
10A
D

COMPUTER CABLE CONNECTORS

BACKGROUND OF THE INVENTION

The present invention relates to computer cable connectors and relates more particularly to the computer cable connectors of which the contacts are respectively consisted of contact terminals and connecting terminals.

Regular male and female computer cable connectors are divided into series type and parallel type. In a series type of computer cable connector, if the wires are respectively connected to the contacts thereof through the process of soldering, the pitch among the contacts thereof should be maintained at 2.77 m/m while it is 2.16 in a parallel type. These computer cable connectors are inexpensive to manufacture. However, performing the process of soldering to connect each wire to each contact will cause environmental pollution problem and simultaneously increase the impedance of each contact. In a series type of computer cable connector in which the wires of a flat cable are respectively connected to the contacts thereof through the process of piercing, the pitch among the tails of the contacts thereof is 2.54 m/m, the pitch among the front contact ends of the contacts thereof is 2.77 m/m. In a parallel type of computer cable connector in which the wires of a flat cable are respectively connected to the contacts thereof through the process of piercing, the pitch among the tails of the contacts thereof is 2.54 m/m, the pitch among the front contact ends of the contacts thereof is 2.16 m/m. Namely, in a computer cable connector in which the wires are respectively connected to the contacts thereof through the process of squeezing, the pitch among the contacts at the front contact ends and the tails thereof is 2.77 m/m:2.54 m/m or 2.16 m/m:2.54 m/m. Therefore, the front contact end of each contact should be processed through the process of punching so as to meet either of the aforesaid specifications. Because the front contact ends of the contacts of each bar of contacts should be turned aside from respective central axes through different angles, it is very difficult to accurately process each contact. If any contact is damaged, a whole bar of contacts becomes useless and shall be thrown away. Because of high defective number, the manufacturing cost is relatively increased. Further, because the front contact ends of the contacts of a bar of contacts are respectively turned aside from respective central axes, the width of the insulators in a computer cable connector shall also be relatively increased.

SUMMARY OF THE INVENTION

The present invention has been accomplished to eliminate the aforesaid disadvantages and problems. It is therefore the main object of the present invention to provide a computer cable connector which is inexpensive to manufacture and provides high performance in signal transmission. According to the present invention, the contacts of a computer cable connector are comprised of a bar of connecting terminals connected to a bar of contact terminals. The bar of connecting terminals and the bar of contact terminals are respectively made from sheets of phosphor bronze through the process of punching. The connecting terminals of the bar of connecting terminals are respectively designed in a flat form so that the defective number of connecting terminals can be minimized. Even if one connecting terminal in a bar of connecting terminals is damaged, the other connecting terminals are still usable.

BRIEF DESCRIPTION OF THE DRAWINGS

FIG. 7 is the front, left and right side views of the male, parallel type of computer cable connector of FIG. 6;

IN DETAILED DESCRIPTION OF THE PREFERRED EMBODIMENT

Figure 8C:
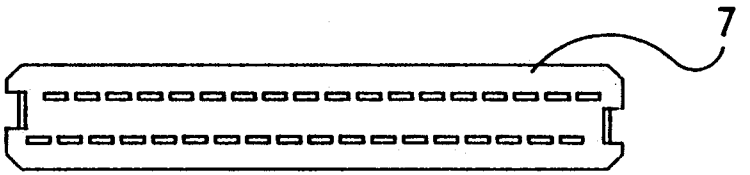
FIG. 8 is the front, left and right side views of a female, parallel type of computer cable connector as constructed according to the present invention.
Figure 8B:
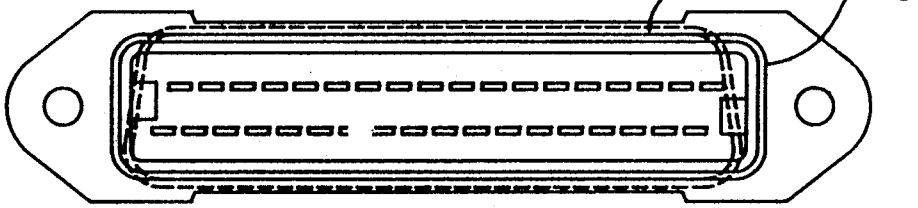
Figure 8:
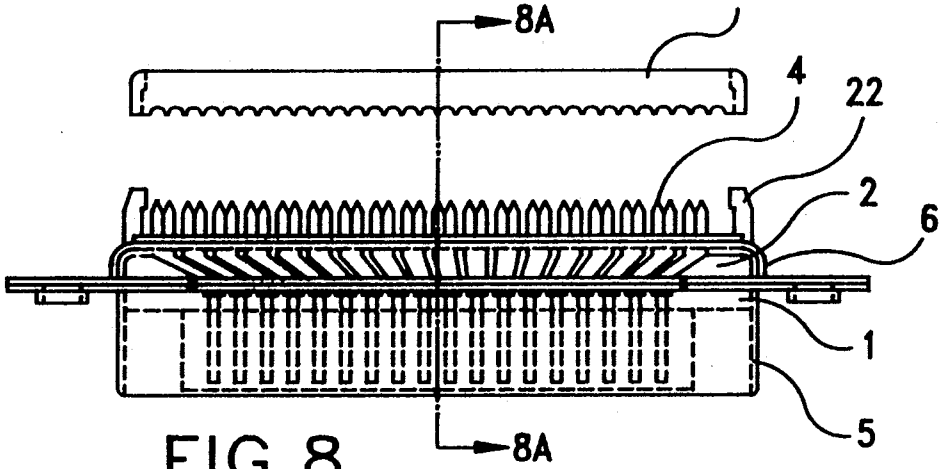
Figure 8A:
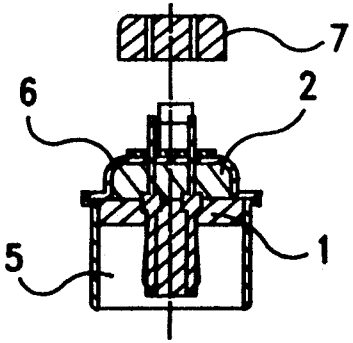
Figure 9:
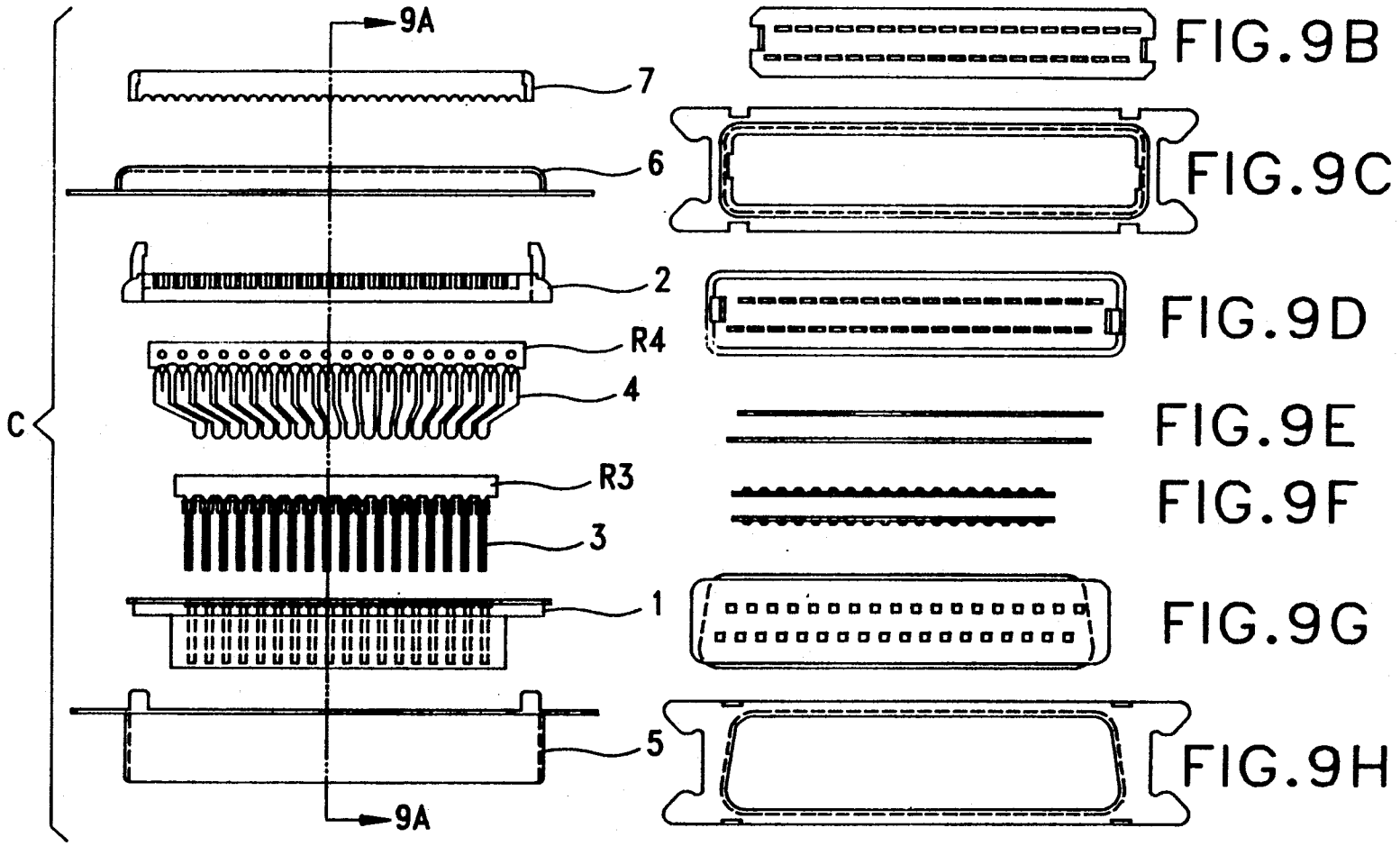
FIG. 9 is an exploded perspective view of the male, parallel type of computer cable connector of FIG. 6.
Figure 9A:
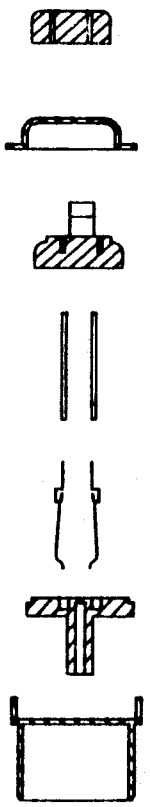
Figures 10, 10A, 10B, 10C, 10D, 10E, 10F, 10G, 10H:
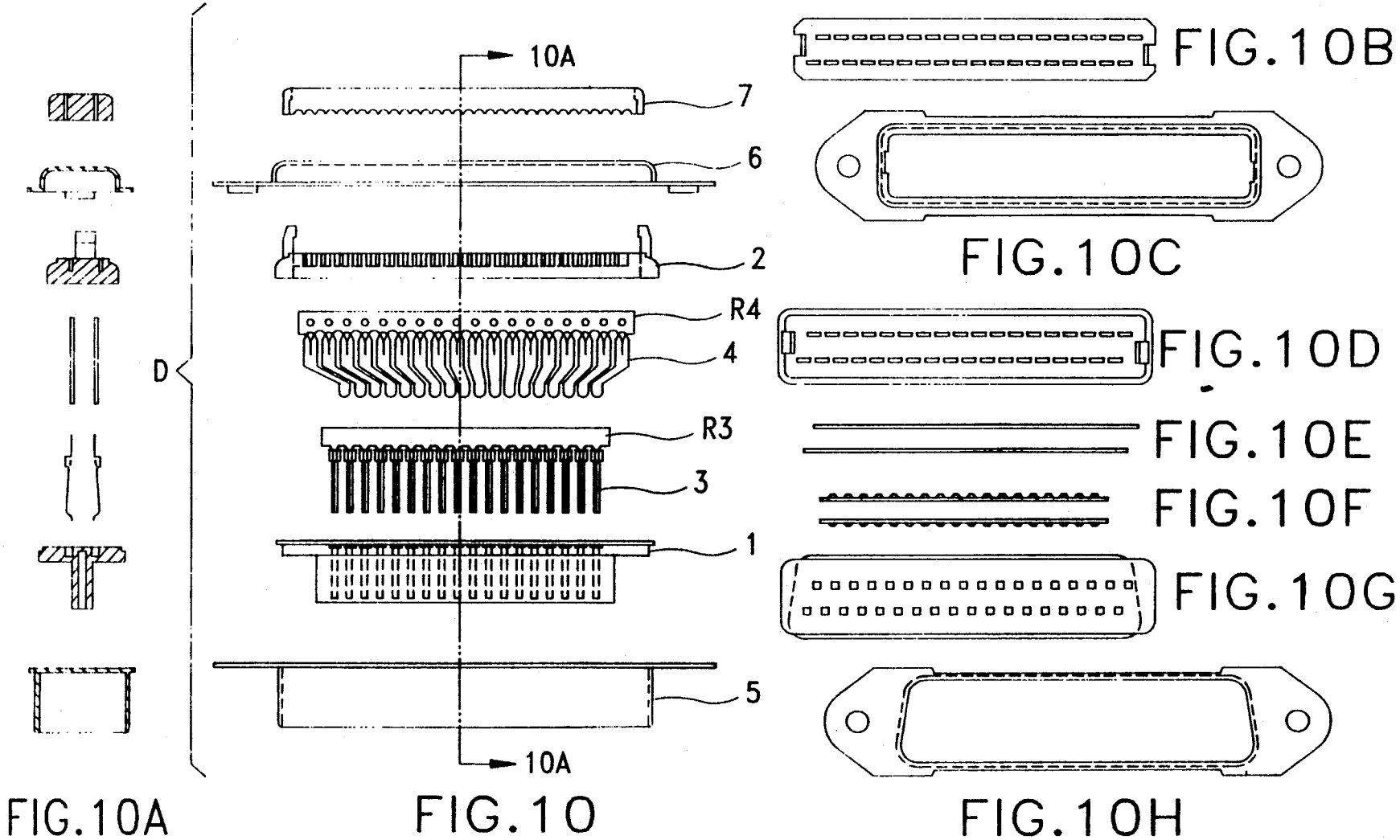
FIG. 10 is an exploded perspective view of the female, parallel type of computer cable connector of FIG. 8.
Figure 11:
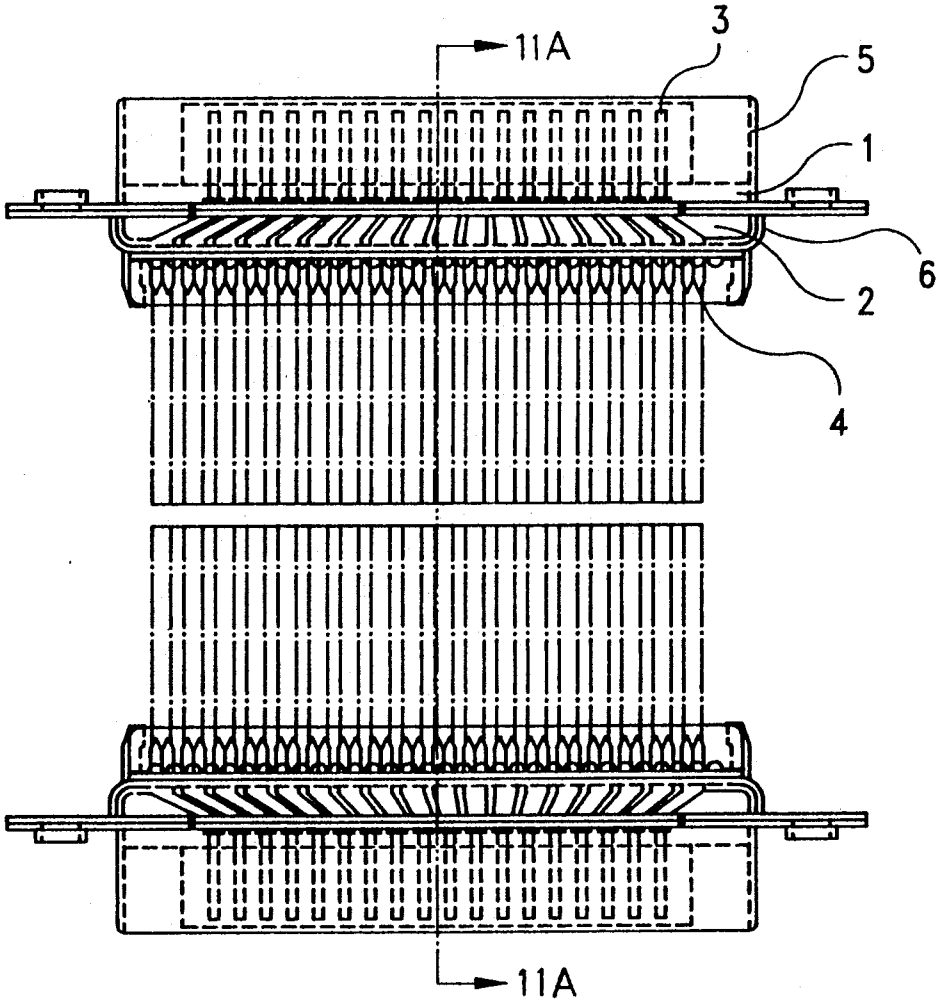
FIG. 11 illustrates a parallel type cable with connectors as constructed according to the present invention.
Figure 11A:
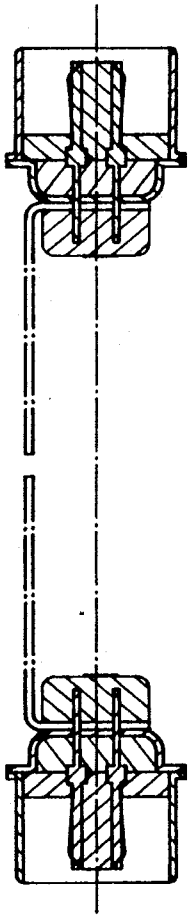
Figure 12:
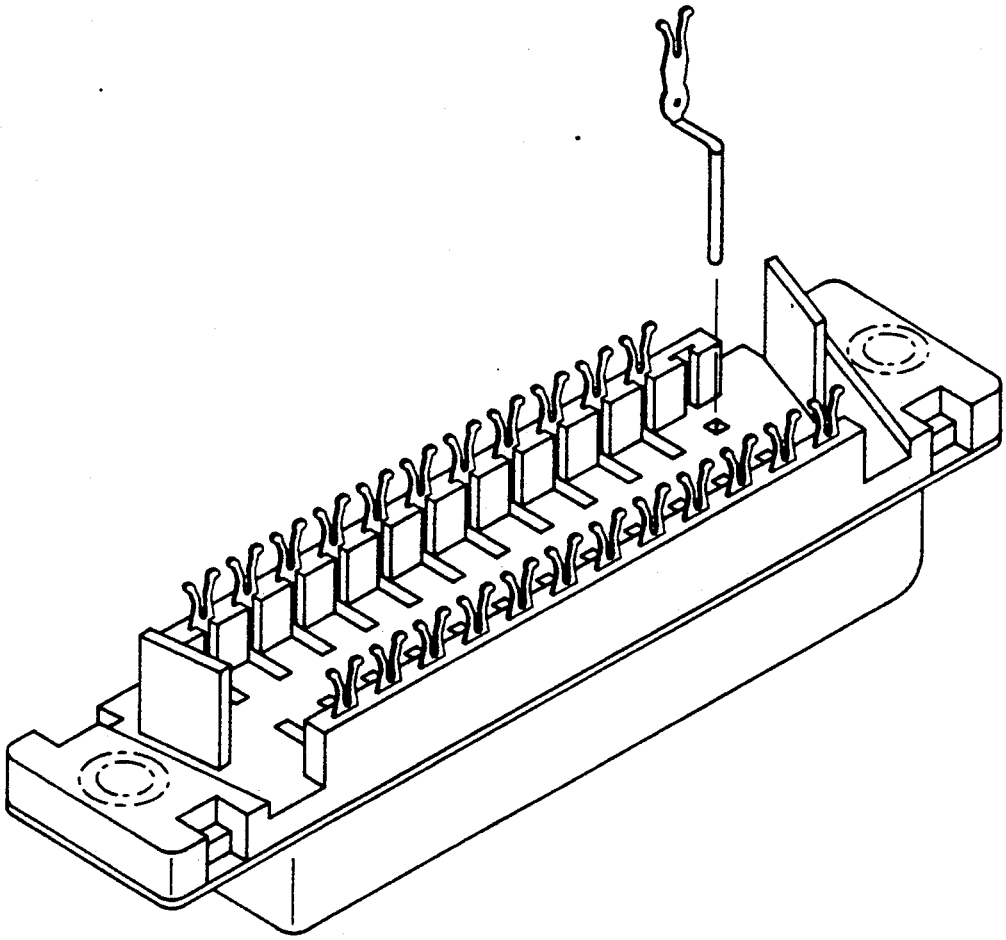
FIG. 12 illustrates a prior art male computer cable connector.

The present invention is practical for use in the manufacturing of a male, series type of computer cable connector A (see FIGS. 1, 2 and 3); a female, series type of computer cable connector B (see FIG. 4); a male, parallel type of computer cable connector C (see FIGS. 6, 7 and 9); and a female, parallel type of computer cable connector D (see FIGS. 8, 10 and 11).

Figure 1:
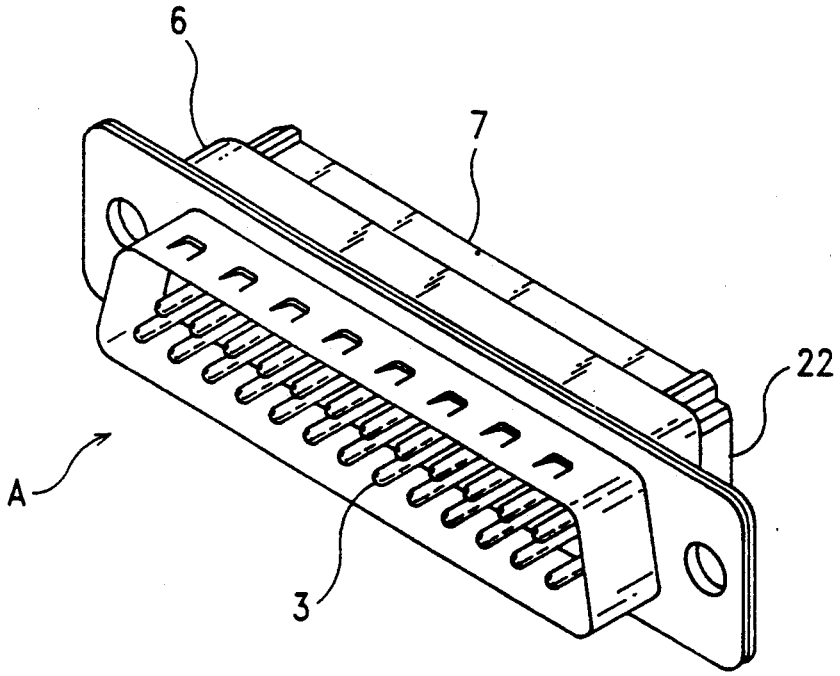
FIG. 1 is a perspective view of a male, series type of computer cable connector as constructed according to the present invention.
Figure 2C:
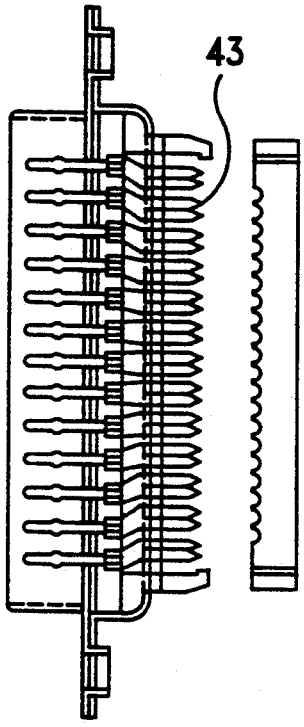
FIG. 2 is the front, left and right side views of the male, series type of computer cable connector of FIG. 1.
Figure 2:
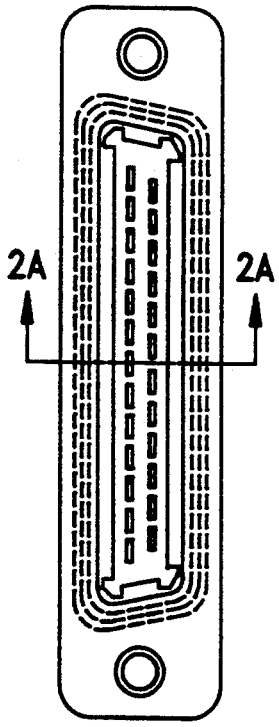
Figure 2B:
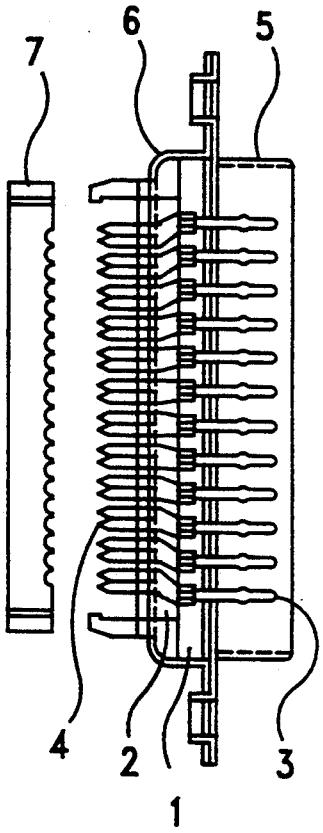
Figure 2A:
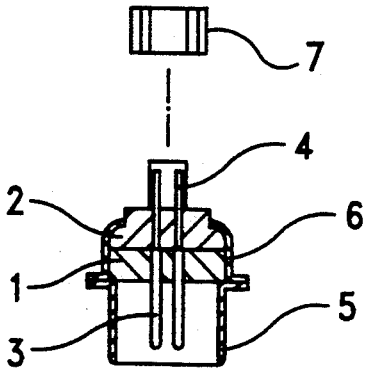
Figure 3:
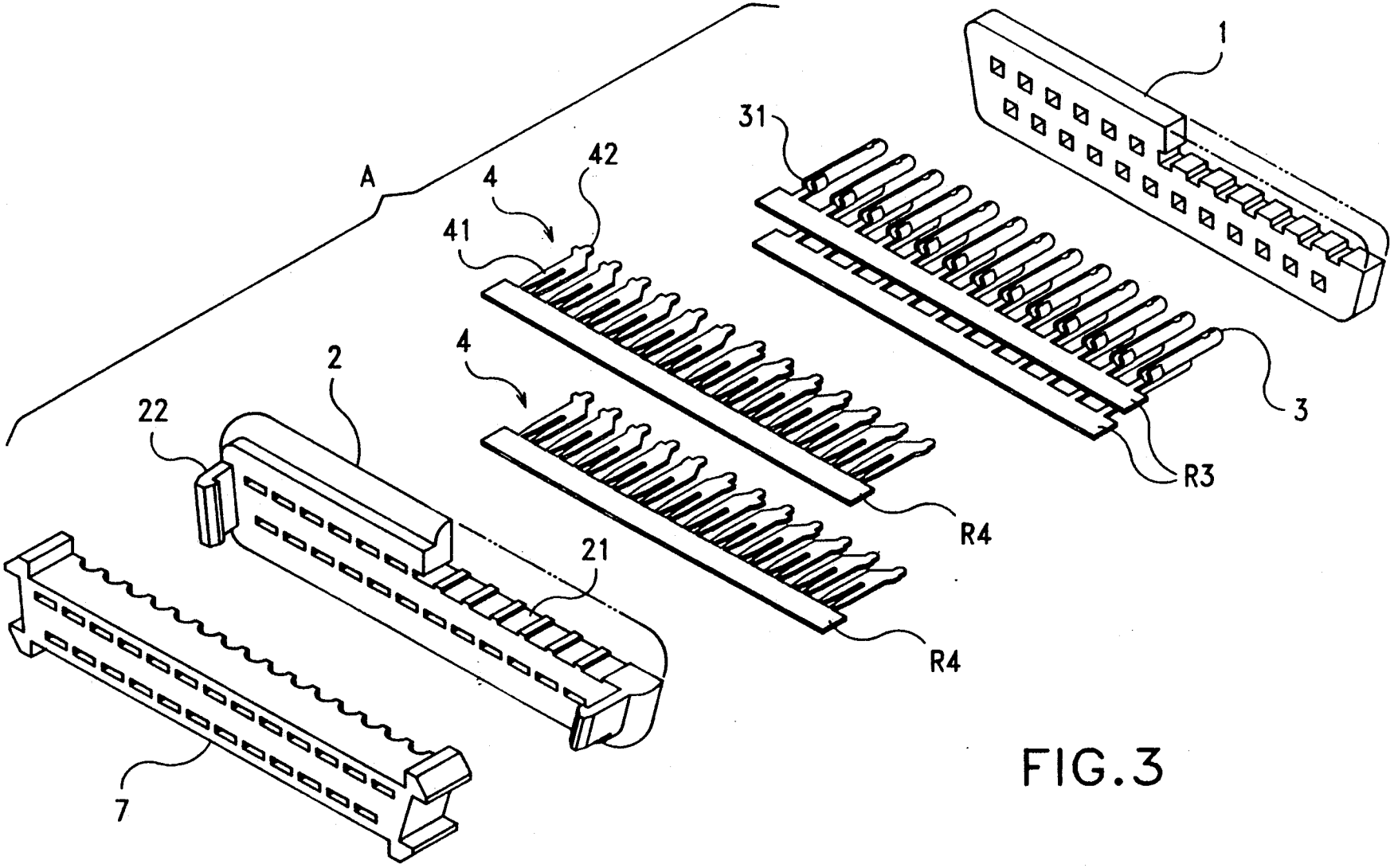
FIG. 3 is an exploded perspective view of the male, series type of computer cable connector of FIG. 1.

Referring to FIGS. 1, 2 and 3, a male, series type of computer cable connector A is generally comprised of a front insulator 1, a rear insulator 2, a bar of contact terminals 3, a bar of connecting terminals 4, a front metal shell 5, a rear metal shell 6 and a locating insulator 7. The front insulator 1 has holes 11 for inserting the bar of contact terminals 3 (each hole 11 includes a countersink at one end thereof, see FIG. 3). The rear insulator 2 has holes 21 for inserting the bar of connecting terminals 4. The front metal shell 5 covers on the front insulator 1. The rear metal shell 6 covers on the rear insulator 2 and connected to the front metal shell 5 through rivet joints. The rear insulator 2 further comprises two resilient hooks 22 at two opposite ends thereof used in securing the locating insulator 7. As illustrated, each connecting terminal 4 has a forked tail 43 which automatically pierces through the insulator of a flat cable, which is retained between the rear insulator 2 and the locating insulator 7, to contact a wire therein when it is inserted through a hole 21 on the rear insulator 2 during the assembly process of a computer cable connector.

Referring to FIG. 3 again, the bar of contact terminals 3 and the bar of connecting terminals 4 are respectively made through the process of punching, wherein the pitch among the contact terminals 3 is set at 2.77 m/m; the pitch among the connecting terminals 4 is set at 2.54 m/m. Each contact terminal 3 is made straight, having a unitary, rectangular frame 31 at a tail thereof. When a contact terminal 3 is inserted through either hole 11 on the front insulator 1, the rectangular frame 31 thereof is retained in the countersink of the hole 11, and therefore, the contact terminal 3 is prohibited from rotating motion for fastening a connecting terminal 4 conveniently. Each connecting terminal 4 is made in a flat shape having a unitary projecting strip 42 at a front end thereof. During the assembly process of the present invention, the projecting strip 42 of each connecting terminal 4 is respectively inserted into the rectangular frame 31 of each contact terminal 3 and then, firmly connected together through a rivet joint respectively. The pitch among the projecting strips 42 of the connecting terminals 4 is set at 2.77 m/m while the pitch among the bodies of the connecting terminals 4 themselves is set at 2.54 m/m. Therefore, only the middle connecting terminal in a bar of connecting terminals has a projecting strip 42 longitudinally aligned with its body 41, while the projecting strips of the other connecting terminals are deviated from respective central axes through different angles.

Figure 5:
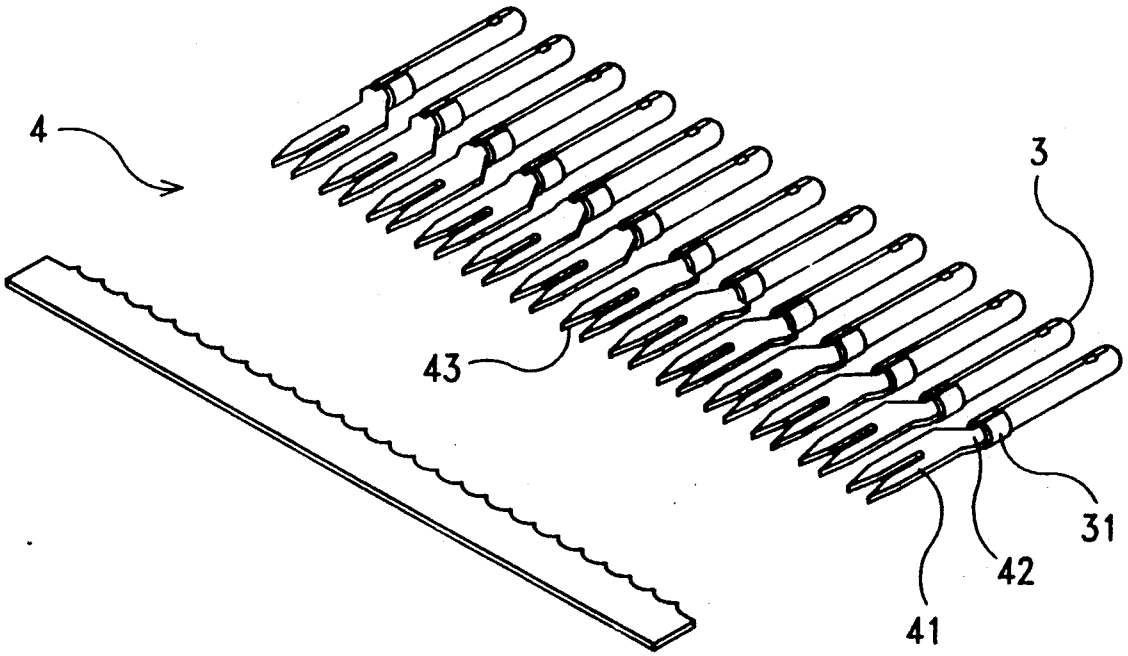
FIG. 5 is a perspective assembly view of a bar of contacts for a male, series type of computer cable connector as constructed according to the present invention.

FIG. 5 illustrates that a bar of connecting terminals 4 are respectively connected to a bar of contact terminals 3. In the present preferred embodiment, the material for the contact terminals 3 is 0.2 t or 0.25 t phosphor bronze, and the material for the connecting terminals 4 is 0.25 t or 0.3 t phosphor bronze. Because each bar of contact terminals 3 and each bar of connecting terminals 4 are respectively formed through the process of punching, the contact terminals 3 or the connecting terminals 4 are still connected together by a residual phosphor bronze material R3 and R4. Once the connecting terminals 4 are respectively connected to the contact terminals, the residual phosphor bronze material R3 or R4 is detached as waste. Because each connecting terminal 4 is made in a flat structure (the projecting strip 42 and the body 41 are disposed in the same plane), it will not be damaged during the process of punching, and therefore, the defective number can be reduced to zero.

Figure 4:
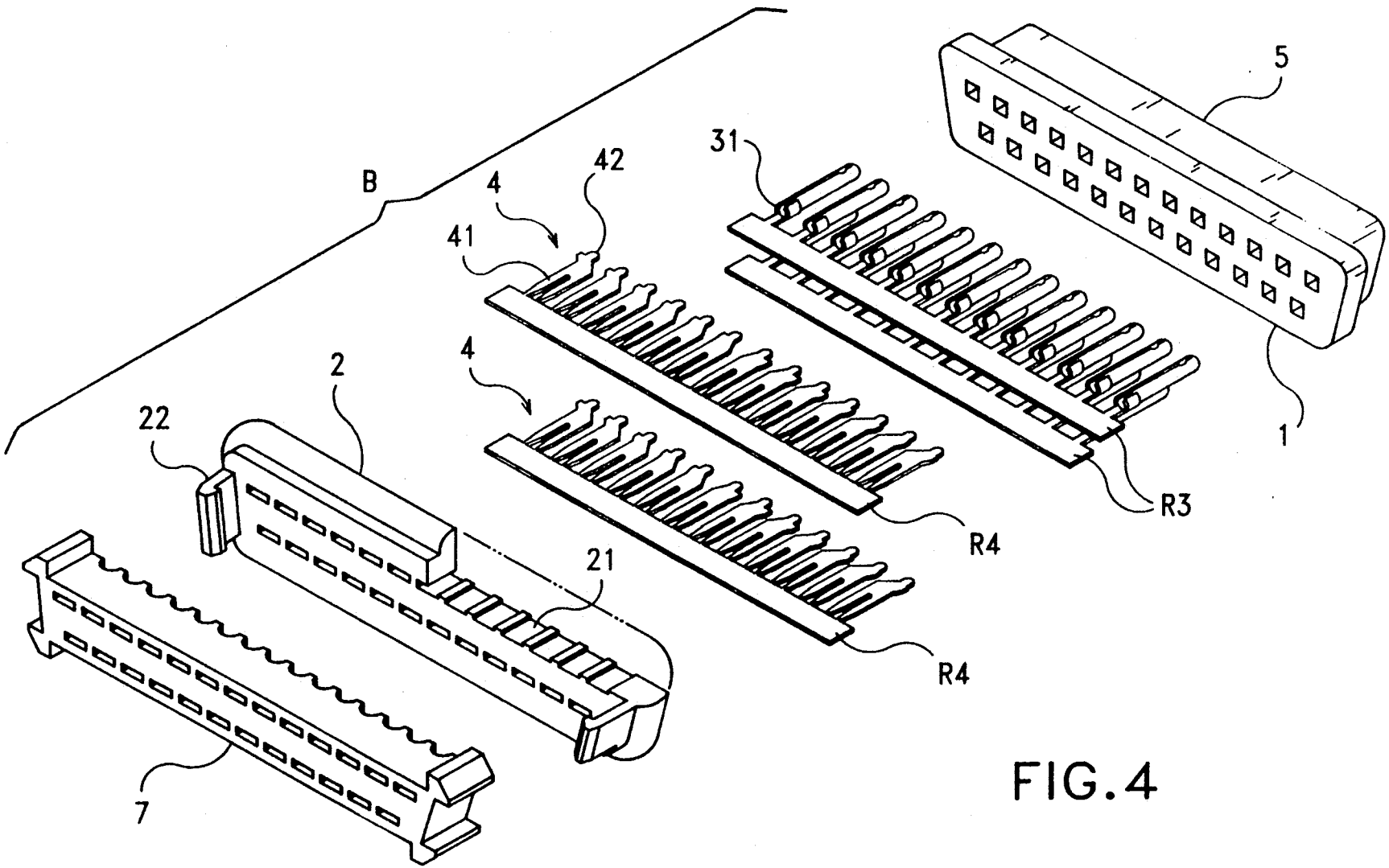
FIG. 4 is an exploded perspective view of a female, series type of computer cable connector as constructed according to the present invention.

FIG. 4 is an exploded prespective view of a female, series type of computer cable connector B as constructed according to the present invention. The contacts thereof are made by connecting a bar of connecting terminals to a bar of duck bill female contact terminals. Similar to the foregoing statement, the defective number can also be greatly reduced.

Figure 6:
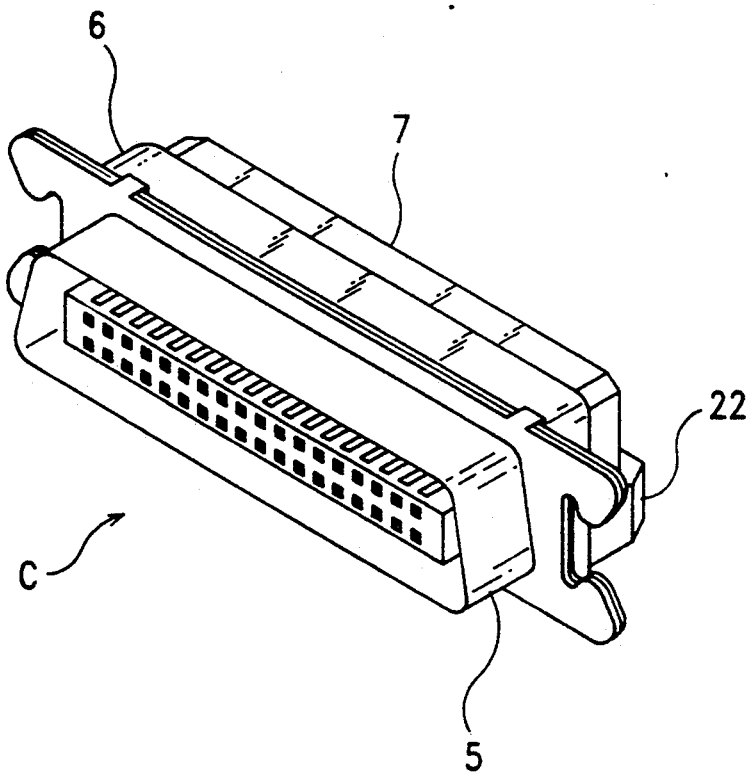
FIG. 6 is a perspective view of a male, parallel type of computer cable connector as constructed according to the present invention.

FIGS. 6, 7 and 9 illustrate a male, parallel type of computer cable connector C as constructed according to the present invention, and FIGS. 8, 10 and 11 illustrate a female, parallel type of computer cable connector D as constructed according to the present invention. The contacts of each connector are formed by connecting a bar of connecting terminals to a bar of contact terminals through rivet joints respectively. Each contact terminal has a unitary, rectangular frame for connecting a connecting terminal. Each connecting terminal has a unitary projecting strip inserted into the rectangular frame of a corresponding contact terminal, and a unitary forked tail inserted through a hole on a rear insulator and pierced through the insulator of a flat cable for electric contact. The pitch among the contact terminals is set at 2.16 m/m. The pitch among the projecting strips of the connecting terminals is set at 2.16 m/m while the pitch among the bodies thereof is set at 2.54 m/m. Because the connecting terminals are respectively made in a flat structure, low defective number can be achieved during the process of punching.

What is claimed is:

1. A computer cable connector, comprising:

a front insulator, said front insulator having a plurality of holes for inserting contacts;

a rear insulator, said rear insulator having two resilient hooks at two opposite ends and a plurality of holes for inserting contacts;

a plurality of contacts, said contacts each having one end inserted through the holes on said front insulator and an opposite end forked and inserted through the holes on said rear insulator;

a front metal shell covered on said front insulator;

a rear metal shell covered on said rear insulator;

a locating insulator secured to said rear insulator by said two resilient hooks;

a flat cable retained between said rear insulator and said locating insulator, said flat cable having a plurality of wires covered by an insulator and respectively disposed in contact with the forked end of each of said contacts; and characterized in that said contacts are consisted of two separate parts, a bar of contact terminals and a bar of connecting terminals, each contact terminal comprising a straight body having a unitary rectangular frame at a tail thereof, each connecting terminal being made in a flat structure including a body, a unitary, flat projecting strip extending from said body at one end and a flat, forked tail extending from said body at an opposite end, said flat projecting strip being inserted into said rectangular frame and secured in place through a rivet joint respectively, the body, the projecting strip and the forked tail of the connecting terminal at the middle of said bar of connecting terminals being longitudinally aligned, the projecting strips of the other connecting terminals being biased from respective central axes through different angles permitting a constant pitch to be maintained between any two adjacent projecting strips.

* * * * *